US005265354A

United States Patent [19]

Aliano, Jr.

[11] Patent Number: 5,265,354

[45] Date of Patent: Nov. 30, 1993

[54] GOLF SHOE INSERT

[76] Inventor: Joseph F. Aliano, Jr., 66 Village Way, Malvern, Pa. 19355

[21] Appl. No.: 798,877

[22] Filed: Nov. 25, 1991

Related U.S. Application Data

[63] Continuation of Ser. No. 442,207, Nov. 28, 1989, abandoned.

[51] Int. Cl.[5] ..... A43B 5/00

[52] U.S. Cl. ..... 36/127; 36/43; 36/25 R

[58] Field of Search ..... 36/127, 25 R, 103, 104, 36/132, 94, 95, 117, 43, 44, 140, 142

[56] References Cited

U.S. PATENT DOCUMENTS

| | | | |
|---|---|---|---|
| 1,870,751 | 8/1932 | Reach | 36/127 |
| 1,958,097 | 5/1934 | Shaw | 36/43 X |
| 2,769,252 | 11/1956 | Monier | 128/589 X |
| 2,847,769 | 8/1958 | Schlesinger | 36/127 |
| 2,855,704 | 10/1958 | Schlesinger | 36/127 |
| 2,959,873 | 11/1960 | Schlesinger | 36/127 |
| 3,732,634 | 5/1973 | Jacobson | 36/127 |
| 3,964,181 | 6/1976 | Holcombe, Jr. | 36/25 R X |
| 4,149,324 | 4/1979 | Lesser et al. | 36/127 |
| 4,161,829 | 7/1979 | Wayser | 36/127 |
| 4,524,531 | 6/1985 | VanDeripe | 36/127 |
| 4,589,216 | 5/1986 | Fuscone | 36/25 R X |
| 4,598,484 | 7/1986 | Ma | 36/43 X |
| 4,682,425 | 7/1987 | Simmons | 36/127 X |
| 4,685,227 | 8/1987 | Simmons | 36/127 |
| 4,754,561 | 7/1988 | Dufour | 36/127 |
| 4,790,083 | 12/1988 | Dufour | 36/127 |
| 4,837,949 | 6/1989 | Dufour | 36/127 |
| 4,934,073 | 6/1990 | Robinson | 36/103 X |
| 4,937,954 | 7/1990 | Clement | 36/127 |
| 5,075,984 | 12/1991 | Shiew | 36/132 X |

OTHER PUBLICATIONS

Advertising material for Golf Tecnic Shoes.
Advertising material for Weight-Rite Golf Shoes.

*Primary Examiner*—Steven N. Meyers
*Assistant Examiner*—Beth Anne Cicconi
*Attorney, Agent, or Firm*—Panitch Schwarze Jacobs & Nadel

[57] ABSTRACT

A pair of improved golf shoes has an inner flange extending longitudinally along the inner side of the shoes and an outer flange extending longitudinally along the outer side of the shoes. The inner flanges and the outer flanges extend outwardly beyond the exterior surfaces of the uppers of the shoes. On one of the improved shoes the outer flange extends outwardly farther than the inner flange. On the other shoe, the inner and outer flanges extend substantially the same distance beyond the exterior surface of the upper. Heels having outwardly extending flanges are provided. One of the heels extends outwardly over substantially its entire outer edge. The flange of the other heel extends outwardly beyond the upper for only a portion of its inner edge and is flush with the upper for the remaining portion of its outer edge. A portion of the shoe disposed below the ball of the foot of the user is thicker than the region disposed below the heel of the user in order to balance the user. The toes of the user may be braced upward to shift the weight of the user back to better balance the user.

7 Claims, 6 Drawing Sheets

GOLF SHOE INSERT

This is a continuation of copending application Ser. No. 07/442,207 filed on Nov. 28, 1989 now abandoned.

FIELD OF THE INVENTION

This invention relates to golf shoes and in particular to golf shoes adapted to shift the weight of a user to provide better position when the user is addressing a golf ball.

BACKGROUND OF THE INVENTION

As is well known, in order to attain a proper stroke it is important that the feet of the player go through prescribed movements at the proper time and in a proper sequence. In one part of the stroke correct foot work is characterized by stability or resistance to a rocking or lateral tilting action whereas in another part of the stroke the foot work is characterized by mobility or freedom for lateral tilting or yielding action. These actions take place in a prescribed sequence with respect to first one foot and then the other.

Attempts have been made to improve a golfer's performance by modifying the design of the sole, heel and spikes of the shoe. See for example U.S. Pat. Nos. 3,732,634, 1,870,751, 4,790,083, 4,524,531, 4,790,083, and 4,149,324, each of which discloses a modification to golf shoes for improving the performance of a golfer.

The swing is very important in the overall performance of a golfer. Coordinated working of the feet and legs is necessary and must be used to initiate the down swing of the golf club. The power source for the swing is the feet and legs. During the back swing the golfer's right foot is moved to bear against the inner edge of the right shoe. This moves the shoulders and the upper portion of the user's body, but not the user's head, into position for the down swing using the leverage of the inner edge of the right foot. By the time the golf club reaches impact, the majority of the weight must have been transferred to the left leg and foot. This clears the left side of the body to enable the completion of the swing toward the target.

The swing and the transfer of the weight to the left leg cause the left foot to roll to the left outer edge during the follow through. U.S. Pat. No. 4,149,324 issued to Lessor on Jan. 25, 1978 teaches a shoe adapted to be comfortable while walking but still assist in these foot and leg motions which are required for a proper stroke. However, the golf shoes taught by Lessor do not assist with proper balance during the address of a golf ball or maintain balance through completion of the swing.

With conventional golf shoe construction, the sole of the golf shoe has an outer flange slight projecting from the upper in a substantially uniform manner along the entire length of the sole. Along the arch region and particularly along the heel region of a conventional shoe the upper projects laterally beyond the sole and the heel. The result is that such conventional shoes cannot produce a restraint against outward rolling, an action which is known as a backward roll. U.S. Pat. No. 3,732,634 issued to Jacobson on Sep. 9, 1971 teaches a golf shoe which is constructed to oppose this tendency toward backward roll. However, the shoe taught by Jacobson does not assist in shifting a golfer's weight in an optimal manner for addressing a golf ball.

Golf shoes are known in which the sole of the shoe is provided with an inclined plane on the side corresponding to its outer left edge. This type of arrangement limits the lateral rolling of the foot on the side of the outer edge during the back swing and provides relative stabilization when the movement is completed. This helps only during the back swing. However, this shoe does not allow the player to have the weight transfer to the outer edge of the left shoe. These shoes often have a number of spikes under the sole to insure good traction with the ground. However, this type of shoe is often found to be uncomfortable and U.S. Pat. No. 4,754,561 issued to Dufour on May 11, 1987 teaches providing an insert for overcoming this problem. However, the insert taught by Dufour is to the side of the shoe and does not assist the user in centering body weight in a way which improves a golfer's address of a golf ball.

SUMMARY OF THE INVENTION

A pair of improved golf shoes has an inner flange extending longitudinally along the inner side of the shoes and an outer flange extending longitudinally along the outer side of the shoes. The inner flanges and the outer flanges extend outwardly beyond the exterior surfaces of the uppers of the shoes. On one of these shoes the outer flange extends outwardly farther than the inner flange. On the other shoe, the inner and outer flanges extend substantially the same distance beyond the exterior surface of the upper. The soles of the shoes are provided with a thickened portion for raising the balls of the feet of the user higher than the heels of the user and bracing the toes of the user higher than the balls of the user thereby shifting the weight of the user backwards.

DETAILED DESCRIPTION OF THE INVENTION

Figure 1:
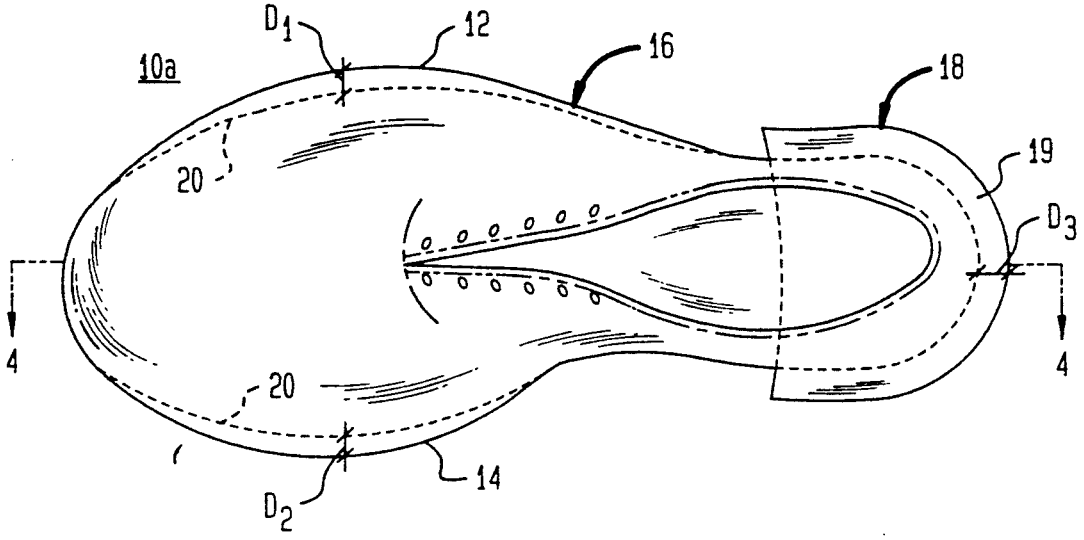
FIG. 1 shows the top view of the improved golf shoe of the present invention.
Figure 2:
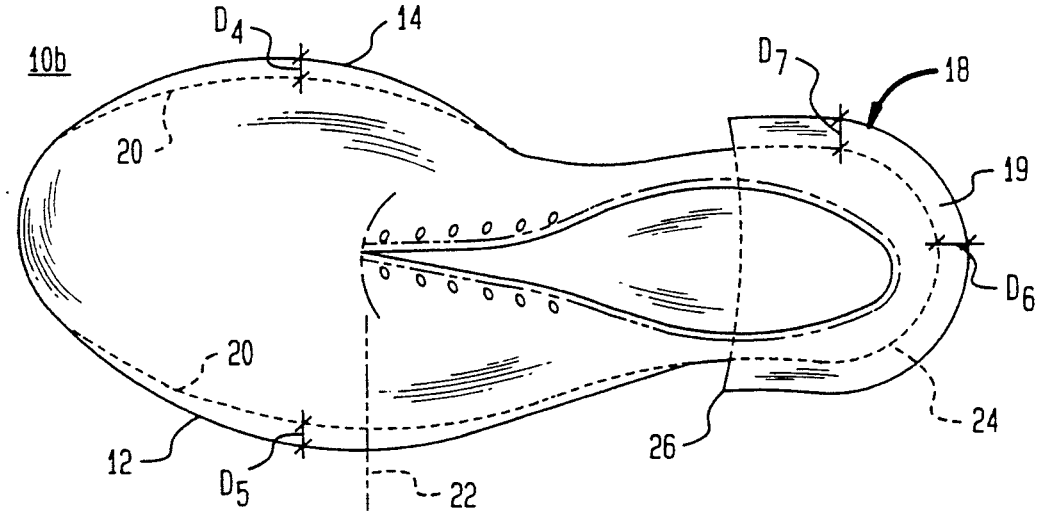
FIG. 2 shows a top view of the left shoe corresponding to the improved left shoe of FIG. 1.
Figure 3:
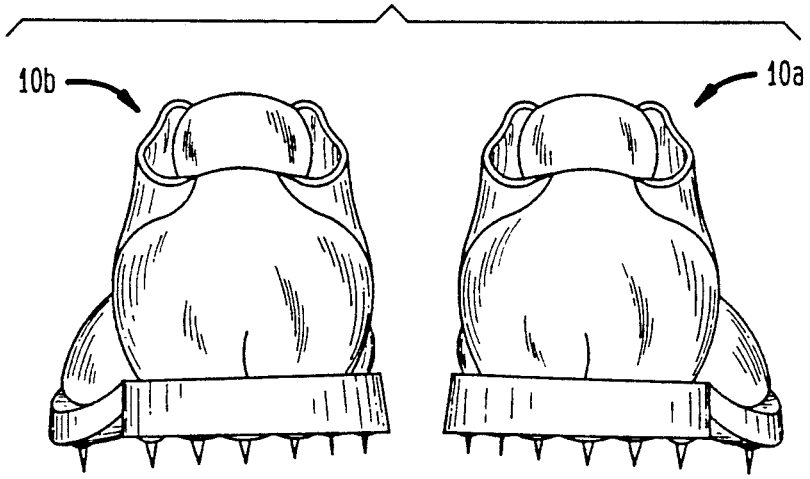
FIG. 3 shows a rear view of the shoes of FIGS. 1 & 2.
Figure 4:
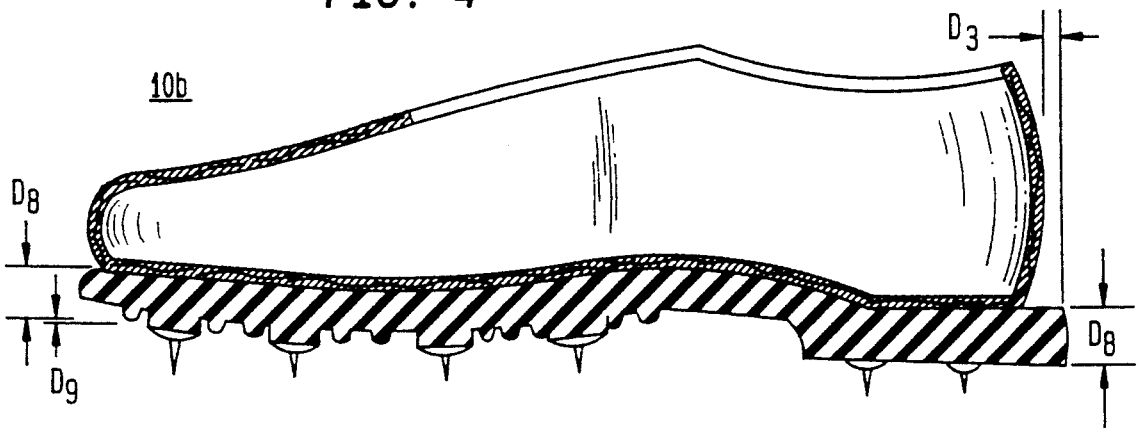
FIG. 4 shows a cross sectional representation of the improved golf shoe of FIG. 2.
Figure 5:
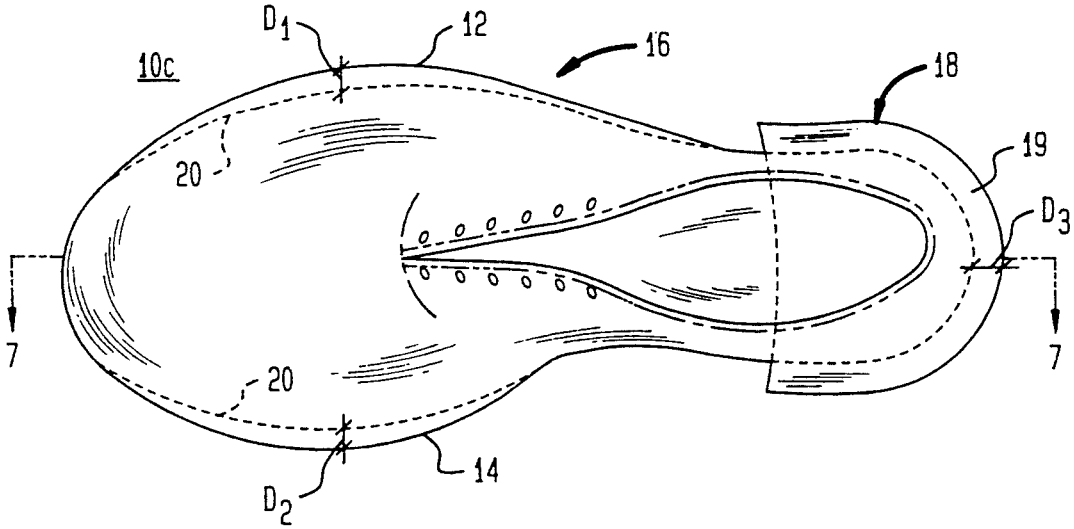
FIG. 5 shows a top view of an alternate embodiment of the improved shoe of FIG. 1.
Figure 6:
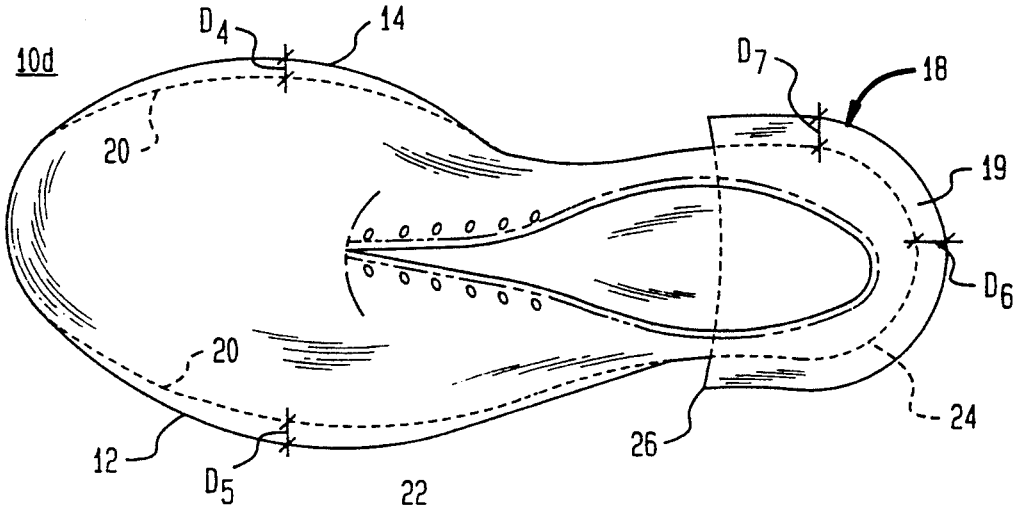
FIG. 6 shows the left shoe corresponding to the improved golf shoe of FIG. 5.
Figure 7:
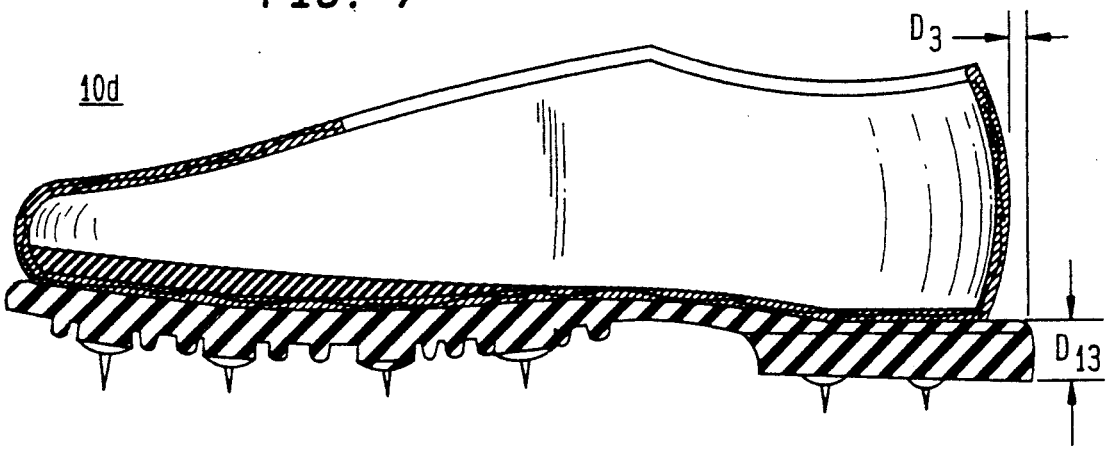
FIG. 7 shows a cross sectional representation of the improved golf shoe of FIG. 6.
Figure 8:
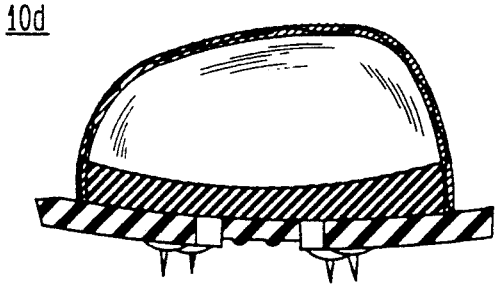
FIG. 8 shows a cross sectional representation of the improved golf shoe of FIG. 6.
Figure 9:
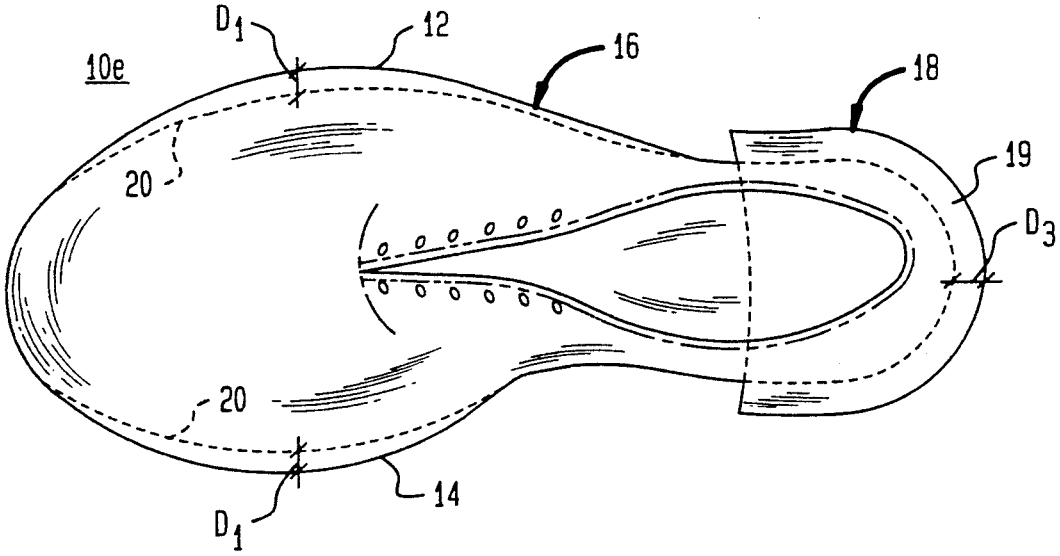
FIG. 9 shows a top view of an alternate embodiment of the improved golf shoe of FIG. 1.
Figure 10:
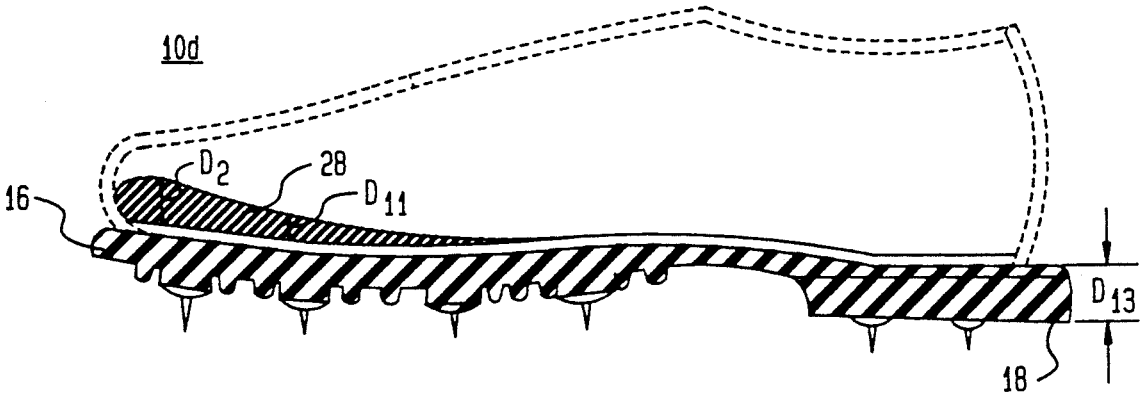
FIG. 10 shows a cross sectional representation of the improved golf shoe of FIG. 9.
Figure 11:
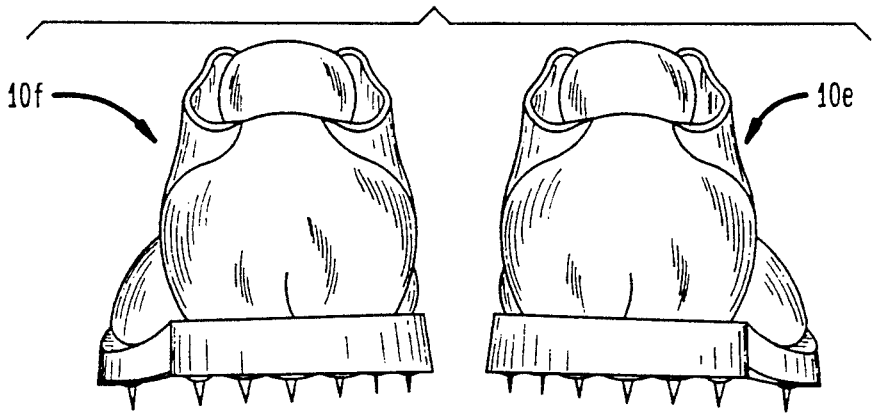
FIG. 11 shows a rear view of the improved golf shoes of FIGS. 9, 12.
Figure 12:
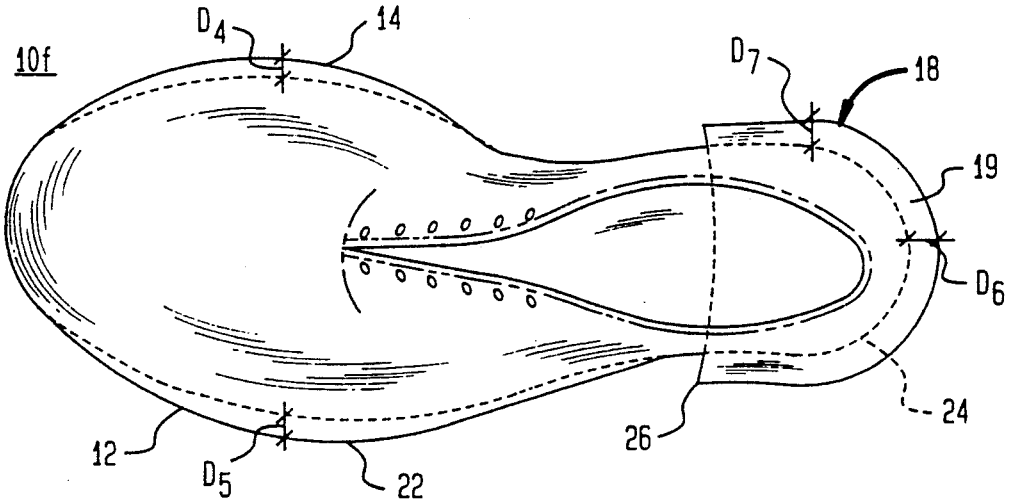
FIG. 12 shows the left shoe corresponding to the improved golf shoe of FIG. 9, FIGS. 13–16 show optional extra grip nub configuration for the shoes of FIGS. 1–12.
Figure 13:
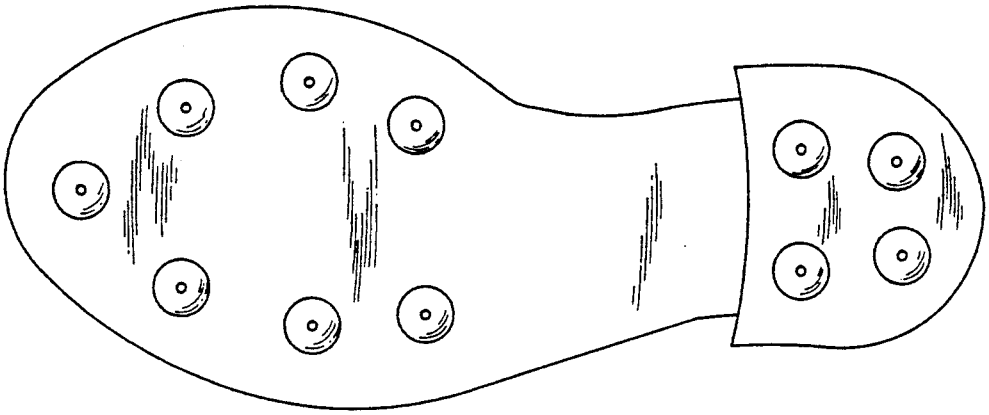
Figure 14:
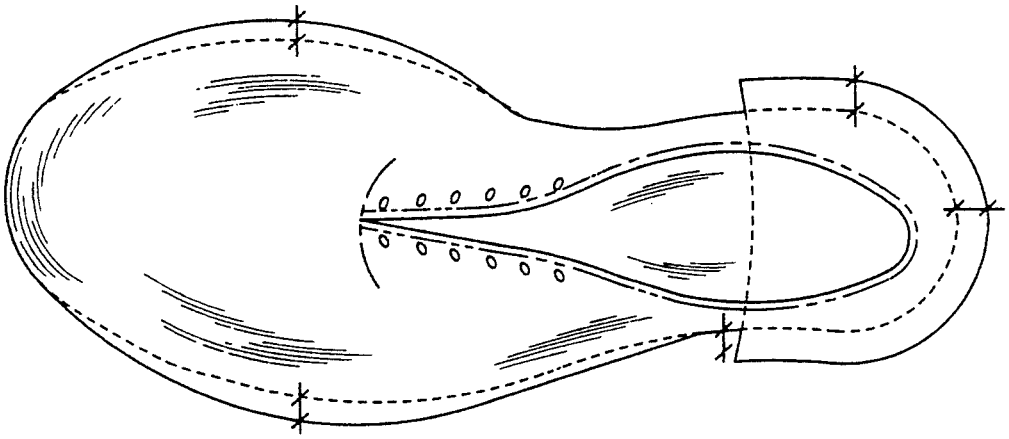
Figure 15:
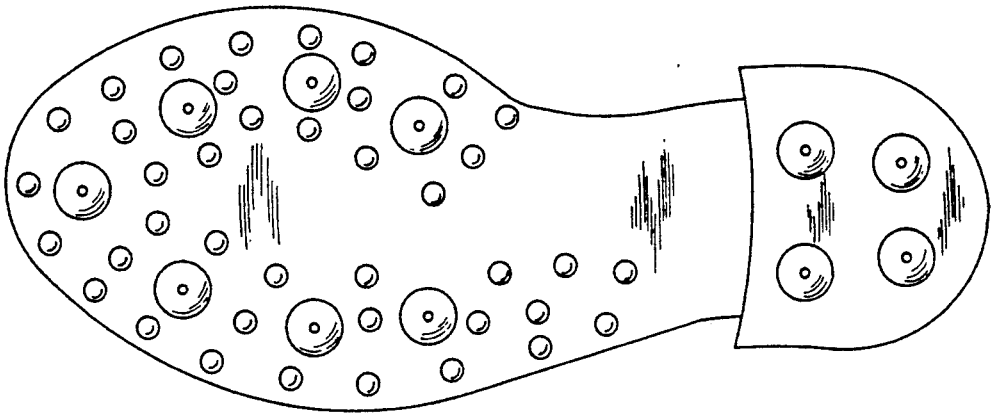
Figure 16:
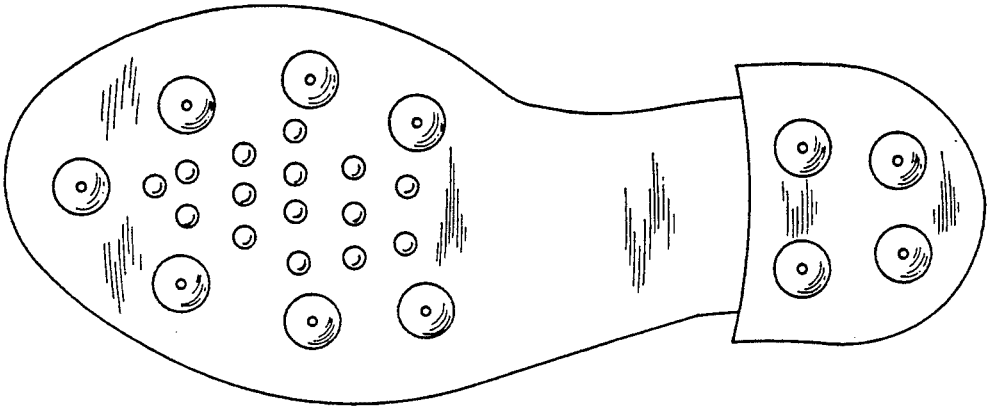

Referring now to FIGS. 1–4, there is shown improved golf shoes 10*a, b* are adapted to center the weight of a user between the balls 10*a, b* are adapted to center the weight of a user between the balls of the feet and the heels of the feet of a user, over the ankles at address and to cause the weight to remain balanced in this manner throughout the golf swing.

Improved golf shoes 10*a,b* of the present invention assist in centering the weight of the user between the balls and heels of the feet over the ankles by providing a portion of soles 16 of golf shoes 10*a,b* disposed under the balls of the feet of the user which is thicker than the portion of soles 16 of shoes 10*a,b* disposed under the heels of the user. Sole 16 is disposed below uppers 20 of improved golf shoes 10*a,b* and uppers 20 are adapted to receive the toes of a user at one end and to receive the heels of a user at a longitudinally opposed end. Additionally, outflares 12,14 are provided on soles 16 of golf shoes 10*a,b* to provide greater stability for the user. Outflares 12, 14 or flanges 12, 14 of soles 16 also prevent swaying during a golf swing and outflares 19 of heels 18 of improved golf shoes 10*a,b* of the present invention prevent the user from falling back after the swing.

Right shoe 10*a* is provided with a sole 16 having an outflare 12 on its outer edge and an outflare 14 on its inner edge. Outflare 12 or outer flange 12 on the outer edge of sole 16 extends a distance $D_1$ beyond the outer side of upper 20. Outflare 14 or inner flange 14 on the inner edge of sole 16 extends beyond the exterior surface of the inner side of upper 20 for a distance $D_2$. $D_1$ may be approximately one-half inch and $D_2$ may be approximately one-quarter inch. The entire outer perimeter of heel 18 is provided with outflare 19 wherein the outer edge of outflare 19 of heel 18 extends a distance $D_3$ beyond the exterior surface of upper 20 at the center of shoe 10*a*. $D_3$ may be approximately one-half inch. It will be understood by those skilled in the art that the dimensions of $D_1$, $D_2$, and $D_3$, as well as any other dimensions set forth herein, are approximations, and that one skilled in the art can provide outflares 12, 14, 19 substantially greater or substantially smaller than the values set forth herein without departing from the spirit of the invention.

In a manner similar to that described for sole 16 of right golf shoe 10*a*, sole 16 of left golf shoe 10*b* is provided with an outflare 14 or inner flange 14 on its inner edge and an outflare 12 or outer flange 12 on its outer edge. Outflare 12 of left golf shoe 10*b* extends a distance $D_5$ beyond the exterior surface of upper 20 and outflare 14 of left golf shoe 10*b* extends a distance $D_4$ beyond the exterior surface of upper 20. Distance $D_4$ and distance $D_5$ may be approximately the same, approximately one-quarter inch.

Outflare 12 on the outer edge of left golf shoe 10*b*, unlike outflare 12 on the outer edge of golf shoe 10*a* extends beyond the exterior surface of upper 20 only from a point 22 of sole 16 to the front tip of golf shoe 10*b*. Between point 22 and heel 18 of golf shoe 10*b*, sole 16 of left golf shoe 10*b* is similar to a conventional sole of a conventional golf shoe. Heel 18 of left golf shoe 10*b* is disposed below a heel region of upper 20 and is provided with outflare 19. Outflare 19 or flange 19 extends a distance $D_6$ beyond the exterior surface of upper 20 except along that portion of heel 18 substantially between point 24 and point 26 of heel 18. The portion of heel 18 between point 24 and point 26 is the same as that of a conventional golf shoe. Distance $D_6$ and $D_7$ may be approximately one-half inch.

In order to shift a player's body weight toward the heels at address and to cause the weight to remain there throughout the golf swing, sole portion 16 of improved left golf shoe 10*b* is thicker than heel portion 18 of improved left golf shoe 10*b*. Heel portion 18 is formed with a thickness $D_8$ while sole portion of improved left golf shoe 10*b* is formed with a thickness of $D_8+D_9$. $D_8$ may be approximately one inch while $D_9$, the additional thickness of sole portion 16 compared with heel portion 18, may have a distance of one half inch. It will be understood by those skilled in the art that the exact dimensions of $D_8$ and $D_9$, are approximations, and that one skilled in the art can provide a thickness of sole portion 16 and heel portion 19 substantially greater or substantially smaller than the value set forth herein without departing from the spirit of the invention.

Referring now to FIGS. 5–8, there is shown improved golf shoes 10*c,d* of the present invention. Improved golf shoes 10*c,d* are an alternate embodiment of improved golf shoes 10*a,b* and are also adapted to center the weight of a user between the balls and heels of the feet of the user, over the ankles at address and to cause the weight of the user to remain balanced throughout the golf swing.

Improved golf shoes 10*c,d* of the present invention assist in centering the weight of the user between the balls and heels of the feet over the ankles by providing a portion of golf shoes 10*a,b* disposed under the balls of the feet of the user which is thicker than the portion of shoes 10*c,d* disposed under the heels. The sole 16 should be raised approximately one-half inch in a graduated manner from the toe and ball portion of the foot, tapering backward towards the heel. Additionally, outflares 12, 14 or flanges 12,14 are provided on soles 16 of golf shoes 10*c,d* to provide greater stability for the user. Outflares 12,14 of soles 16 also prevent swaying during a golf swing and outflares 19 of heels 18 of improved golf shoes 10*c,d* of the present invention prevent the user from falling back after the swing.

Right shoe 10*c* is provided with a sole 16 having an outflare 12 or outer flange 12 on its outer edge and an outflare 14 on its inner edge. Outflare 12 on the outer edge of sole 16 extends a distance $D_1$ beyond the exterior surface of upper 20. Outflare 14 or inner flange 14 on the inner edge of sole 16 extends beyond upper 20 for a distance $D_2$. $D_1$ may be approximately one-half inch and $D_2$ may be approximately one-quarter inch. The entire outer perimeter of heel 18 is provided with outflare 19 wherein the outer edge of outflare 19 of heel 18 extends a distance $D_3$ beyond upper 20 at the center of shoe 10*c*. $D_3$ may be approximately one-half inch. As previously described, it will be understood by those skilled in the art that the exact dimensions of $D_1$, $D_2$, and $D_3$ of improved golf shoes 10*c,d*, as well as any other dimensions set forth herein, are approximations, and that one skilled in the art can provide outflares 12, 14, 19 substantially greater or substantially smaller than the values set forth herein without departing from the spirit of the invention.

In a manner similar to that described for sole 16 of right golf shoe 10*c*, sole 16 of left golf shoe 10*d* is provided with an outflare 14 on its inner edge and an outflare 12 on its outer edge. Outflare 12 of left golf shoe 10*d* extends a distance $D_5$ beyond the exterior surface of upper 20 and outflare 14 of left golf shoe 10*d* extends a distance $D_5$ beyond the exterior surface of upper 20. Distance $D_4$ and distance $D_5$ may be approximately the same, approximately one-quarter inch. Outflare 12 on the outer edge of left golf shoe 10*d*, unlike outflare 12 on the outer edge of golf shoe 10*c* extends beyond upper 20 only from a point 22 of sole 16 to the front tip of golf shoe 10*d*. Between point 22 and heel 18 of golf shoe 10*d*, sole 16 of left golf shoe 10*d* is similar to a conventional sole of a conventional golf shoe. Heel 18 of left golf shoe 10*d* is provided with outflare 19 which extends a distance $D_6$ beyond the edge of upper 20 except along that portion of heel 18 substantially between point 24 and point 26 of heel 18. The portion of heel 18 between point 24 and point 26 is the same as that of a conventional golf shoe. The distance $D_6$ may be approximately one-half inch.

Referring now to FIGS. 9–12, there is shown improved golf shoes 10*e,f* of the present invention. Improved golf shoes 10*e,f* are an alternate embodiment of improved golf shoes 10*a,b* and are also adapted to center the weight of a user between the balls and heels of the feet of the user over the ankles at address and to cause the weight to remain balanced throughout the golf swing.

Improved golf shoes 10*e,f* of the present invention assist in centering the weight of the user between the balls and heels of the feet over the ankles. This is done by providing a thickened portion 28 of soles 16 of improved golf shoes 10*e, f* disposed under the balls of the feet of the user and in particular under the toes of the user which is thicker than the portion of soles 16 shoes 10*e,f* disposed under the heels of the user. Although outflares are optionalved golf shoes 10*e,f*, outflares 12, 14 may be provided on soles 16 of golf shoes 10*e,f* to provide greater stability for the user. Outflares 12,14 of soles 16 also prevent swaying during a golf swing and outflares 19 of heels 18 of improved golf shoes 10*e,f* prevent the user from falling back after the swing.

Figure 17:
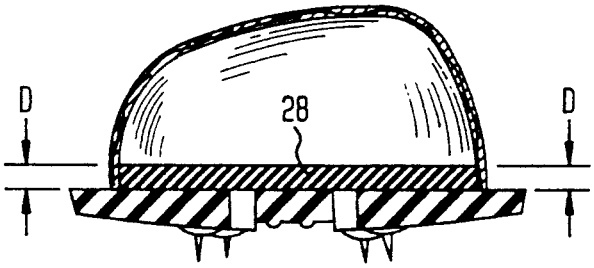
FIG. 17 shows a cross-sectional view of the insert of the present invention.

Thickened portion 28 or bracing portion 28 of improved golf shoes 10*e,f* increases the thickness beneath the ball of the foot of a user by approximately one-quarter inch and the thickness of bracing portion 28 tapers in the direction backwards towards heel 18. Bracing portion 28 in the region from the ball of the foot forward to the ends of the toes of the user is formed with increasing thickness in order to position and brace the toes in an upward manner. In order to position and brace the toes of the user in this manner the distance $D_{11}$ may be approximately one-quarter inch and the distance $D_{12}$ may be approximately one-half inch. Thickened portion 28 may be formed of a thickening of sole 16 itself or by an insert 28 which is disposed against sole 16. Such an insert 28 may be disposed in conventional shoes. While portion 28 or insert 28 tapers from toe to heel, portion 28 or insert 28 is preferably of uniform thickness from left to right as represented in FIG. 17 as insert 28*a*.

The effect of bracing the toes of the user in an upward position in this manner by bracing portion 28 is to shift the weight of the user back onto the balls and heels of the feet. This causes the weight to be better centered over the ankles of the user. In order to further assist in this centering of the weight of the user the thickness of heel 18 may be decreased. For example distance $D_{13}$ of improved golf shoes 10*e,f* may be approximately one-quarter inch less than that of conventional golf shoes wherein conventional shoes are typically approximately one inch.

If optional outflares are provided for improved golf shoes 10*e,f* having thickened portion 28, right shoe 10*e* is formed with a sole 16 having an outflare 12 on its outer edge and an outflare 14 on its inner edge. Outflare 12 on the outer edge of sole 16 extends a distance $D_1$ beyond upper 20. Outflare 14 on the inner edge of sole 16 extends beyond upper 20 for a distance $D_2$. $D_1$ may be approximately one-half inch and $D_2$ may be approximately one-quarter inch. The entire outer perimeter of heel 18 is provided with outflare 19 wherein the outer edge of outflare 19 of heel 18 extends a distance $D_3$ beyond upper 20 at the center of shoe 10*e*. $D_3$ may be approximately one-half inch.

In a manner similar to that described for sole 16 of right golf shoe 10*e*, sole 16 of left golf shoe 10*f* is provided with an outflare 14 on its inner edge and an outflare 12 on its outer edge. Outflare 14 of left golf shoe 10*e* extends a distance $D_4$ beyond upper 20 and outflare 12 of left golf shoe 10*f* extends a distance $D_5$ beyond upper 20. Distance $D_4$ and distance $D_5$ may be approximately the same, approximately one-quarter inch.

Referring now the FIGS. 13–16 there are shown configurations of metal spikes and rubber spikes or nubs which may be applied to shoes 10*a–f*. Each sole 16 of shoes 10*a–f* may be provided with a combination of metal spikes and nubs. The nubs begin where the metal spikes end to assure a better grip when the user is addressing a ball.

The rubber nubs of the outer from the center of sole 16 to the toe region of sole 16 are shorter than the rest of the rubber nubs to allow free movement of the user's feet during the golf swing.

While this invention has been described with reference to specific, and particularly preferred, embodiments thereof, it is not limited thereto and the appended claims are intended to be construed to encompass not only the specific forms and variants of the invention shown but to such other forms and variants as may be devised by those skilled in the art without departing from the true spirit and scope of this invention.

I claim:

1. A pair of improved golf shoes, each shoe of said pair of golf shoes having an upper for receiving a foot and a sole connected to and extending beneath said upper, said upper having longitudinally opposed toe and heel regions, comprising:

a continuously curving medial flange on each of said soles extending longitudinally along a medial side of said upper and extending outwardly beyond an exterior surface of said upper for at least a portion of said medial side of said upper, a continuously curving lateral flange on each of said soles extending longitudinally along a lateral side of said upper and extending outwardly beyond an exterior surface of said upper for at least a portion of said lateral side of said upper, said lateral flange extending outwardly beyond said exterior surface of said upper substantially farther than said medial flange on a first shoe or said pair of shoes so that said lateral flange is wider than said medial flange on said first shoe, and said lateral flange extending outwardly beyond said exterior surface of said upper substantially the same as said medial flange on a second shoe of said pair of shoes so that the width of said lateral flange is substantially equal to the width of said medial flange on said second shoe, and a front bracing portion having a thickness substantially toward the front of said sole below the toes of the user which is greater than the thickness below the balls of the feet of the user wherein said thickness increases substantially continuously in the direction of the toes said bracing portion having a substantially uniform thickness form side to side, for bracing the toes of the user in an upward position to shift the weight of the user back towards the rear of the foot.

2. The pair of improved golf shoes of claim 1, further comprising:

first and second heels disposed below first and second heel regions respectively of first and second uppers of said shoes, said first heel having a flange extending outwardly beyond an exterior surface of said first upper over substantially the entire outer edge of said first heel, and said second heel having a flange extending outwardly beyond an exterior surface of said second upper along a portion of the inner edge of said and being flush with the exterior surface of said second upper along the remaining portion of the outer edge of said second heel.

3. The improved golf shoes of claim 1 wherein each of said soles comprises a thickened portion having region disposed below the ball of the foot of a user which is thicker than the region disposed below the heel of the user.

4. The improved golf shoes of claim 2, wherein each of said soles comprises a thickened portion adapted to provide a region disposed below the ball of the foot of a user which is thicker than the region disposed below the heel of the user.

5. The improved golf shoes of claim 2, wherein said flush portion is on the outer edge of said second heel.

6. A pair of improved golf shoes, each shoe of said pair of golf shoes having an upper for receiving a foot and a sole connected to and extending beneath said upper, said upper having longitudinally opposed toe and heel regions, comprising:

a continuously curving medial flange on each of said shoes extending longitudinally along a medial side of said upper and extending outwardly beyond an exterior surface of said upper for at least a portion of said medial side of said upper, a continuously curving lateral flange on each of said soles extending longitudinally along a lateral side of said upper and extending outwardly beyond an exterior surface of said upper for at least a portion of said lateral side of said upper, said lateral flange extending outwardly beyond said exterior surface of said upper substantially farther than said medial flange on a first shoe of said pair of shoes so that said lateral flange is wider than said medial flange on said first shoe, said lateral flange extending outwardly beyond said exterior surface of said upper substantially the same distance as said medial flange on the second shoe of said pair of shoes so that the width of said lateral flange is substantially equal to the width of said medial flange on said second shoe, and a front bracing portion having a thickened portion substantially toward the front of said shoes, said thickened portion increasing in thickness only from the vicinity of the balls of the feet of the user to below the toes of the user to provide a thickness under said toes which is greater than the thickness below said balls of said feet wherein said thickness increases substantially continuously in the direction of the toes said bracing portion having a substantially uniform thickness from side to side, for bracing the toes of the user in an upward position to shift the weight of the user back toward the rear of the foot.

7. The pair of improved golf shoes of claim 6, wherein said thickened portion begins increasing in thickness forward of the balls of the feet.

* * * * *